United States Patent [19]

Zahn et al.

[11] Patent Number: 4,534,471

[45] Date of Patent: Aug. 13, 1985

[54] STAMP HOLDING CLIP AND RACK THEREFOR

[75] Inventors: William L. Zahn, Brookfield; Fred W. Kufrin, Janesville, both of Wis.

[73] Assignee: Schwaab Inc., Milwaukee, Wis.

[21] Appl. No.: 488,678

[22] Filed: Apr. 27, 1983

[51] Int. Cl.[3] ..... A47F 5/02

[52] U.S. Cl. ..... 211/39; 211/163

[58] Field of Search ..... 211/39, 607, 66, 70, 211/131, 163, 94; 248/215, 214, 340

[56] References Cited

U.S. PATENT DOCUMENTS

| | | | |
|---|---|---|---|
| 316,062 | 4/1885 | Riessner . | |
| 422,056 | 2/1890 | Martin . | |
| 643,715 | 2/1900 | Folger . | |
| 646,969 | 4/1900 | Folger . | |
| 652,257 | 6/1900 | Folger | 211/39 |
| 807,757 | 12/1905 | Martin . | |
| 1,095,068 | 4/1914 | Bate | 248/110 |
| 1,208,533 | 12/1916 | Folger . | |
| 1,242,017 | 10/1917 | Mendelsohn | 211/39 |
| 3,202,297 | 8/1965 | Hardy | 211/163 |
| 3,314,177 | 4/1967 | Mies et al. | 211/163 X |
| 3,515,284 | 6/1970 | Taylor | 211/94 |

FOREIGN PATENT DOCUMENTS

| | | | |
|---|---|---|---|
| 134646 | 8/1929 | Switzerland | 211/39 |
| 733076 | 7/1955 | United Kingdom | 108/94 |
| 1595578 | 8/1981 | United Kingdom | 211/94 |

OTHER PUBLICATIONS

Cosco Rubber Stamp Racks (p. 80).
Atlas Desk Stamp Racks (p. 81).
Schwaab Stamp Pads, Ink and Racks (p. 10).

*Primary Examiner*—Robert W. Gibson, Jr.
*Attorney, Agent, or Firm*—Andrus, Sceales, Starke & Sawall

[57] ABSTRACT

The present invention is directed to an improved clip and supporting rack therefor. The clip is constructed with rigid outwardly diverging arms to eliminate the need to force the stamp handle through a throat, and does not require spring loading. Furthermore, the clip easily accommodates stamps having handles of numerous sizes and shapes. One embodiment of supporting rack is free standing and provides circular clip supports forming storage bins for small items such as paper clips and the like. The load from the clips and stamps on the supports is carried down through a central post. Another embodiment of rack is adapted to be straight and wall mounted with spaces provided to permit snap-on of the clips.

11 Claims, 5 Drawing Figures

STAMP HOLDING CLIP AND RACK THEREFOR

U.S. PRIOR ART OF INTEREST 316,062, Riessner, Apr. 21, 1885;
422,056, Martin, Feb. 25, 1890;
643,715, Folger, Feb. 20, 1900;
646,969, Folger, Apr. 10, 1900;
807,757, Martin, Dec. 19, 1905;
1,208,533, Folger, Dec. 12, 1916.

BACKGROUND AND SUMMARY OF THE INVENTION

This invention relates to a clip for holding rubber stamps and the like, as well as to a rack for holding a plurality of such clips.

The above identified patents are illustrative of known stamp holding clips which utilize flexible spring loaded metal clamps providing a narrow entrance throat through which a stamp handle must be manually forced before it can hang from an enlarged support portion. Some of these patents also suggest attaching the clips to a support strip or bar via a snap-on arrangement.

The present invention is directed to an improved clip and supporting rack therefor. The clip is constructed with rigid outwardly diverging arms to eliminate the need to force the stamp handle through a throat, and does not require spring loading. Furthermore, the clip easily accomodates stamps having handles of numerous sizes and shapes. One embodiment of supporting rack is free standing and provides circular clip supports forming storage bins for small items such as paper clips and the like. The load from the clips and stamps on the supports is carried down through a central post. Another embodiment of rack is adapted to be straight and wall mounted with spaces provided to permit snap-on of the clips.

BRIEF DESCRIPTION OF THE DRAWINGS

The accompanying drawings illustrate the best mode presently contemplated by the inventors for carrying out the invention.

In the drawings.

DESCRIPTION OF THE PREFERRED EMBODIMENT

Figure 1:
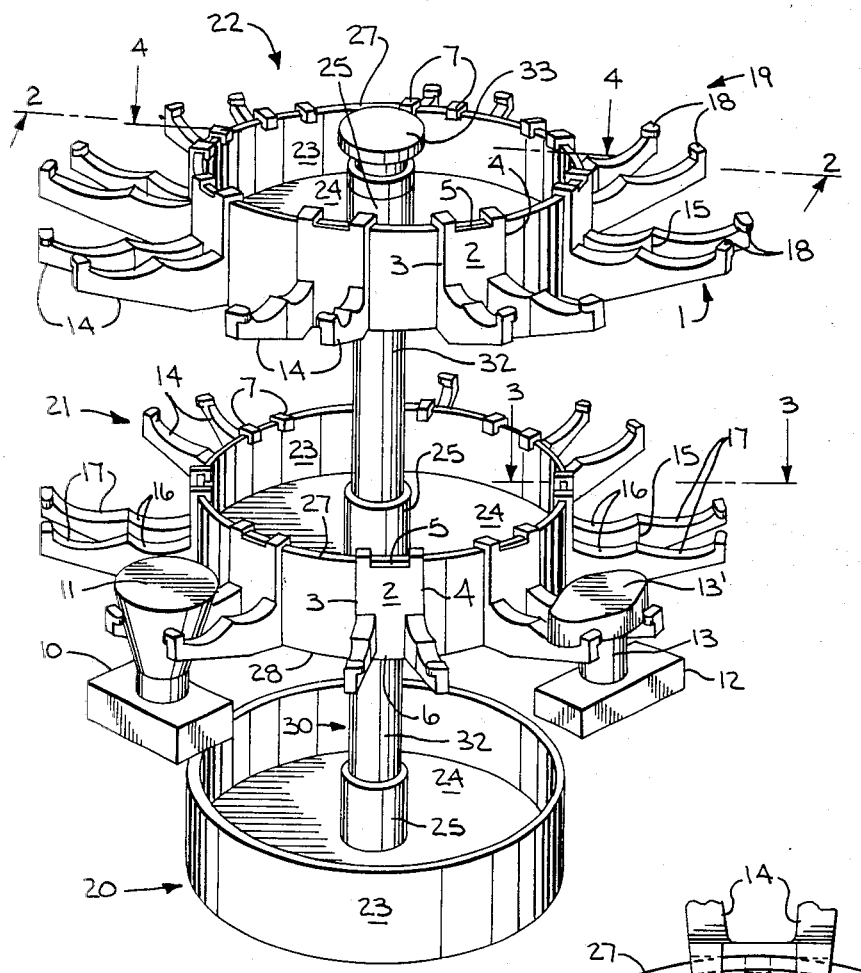
FIG. 1 is a perspective view of a plurality of stamp holding clips mounted to one form of supporting rack.
Figure 4:
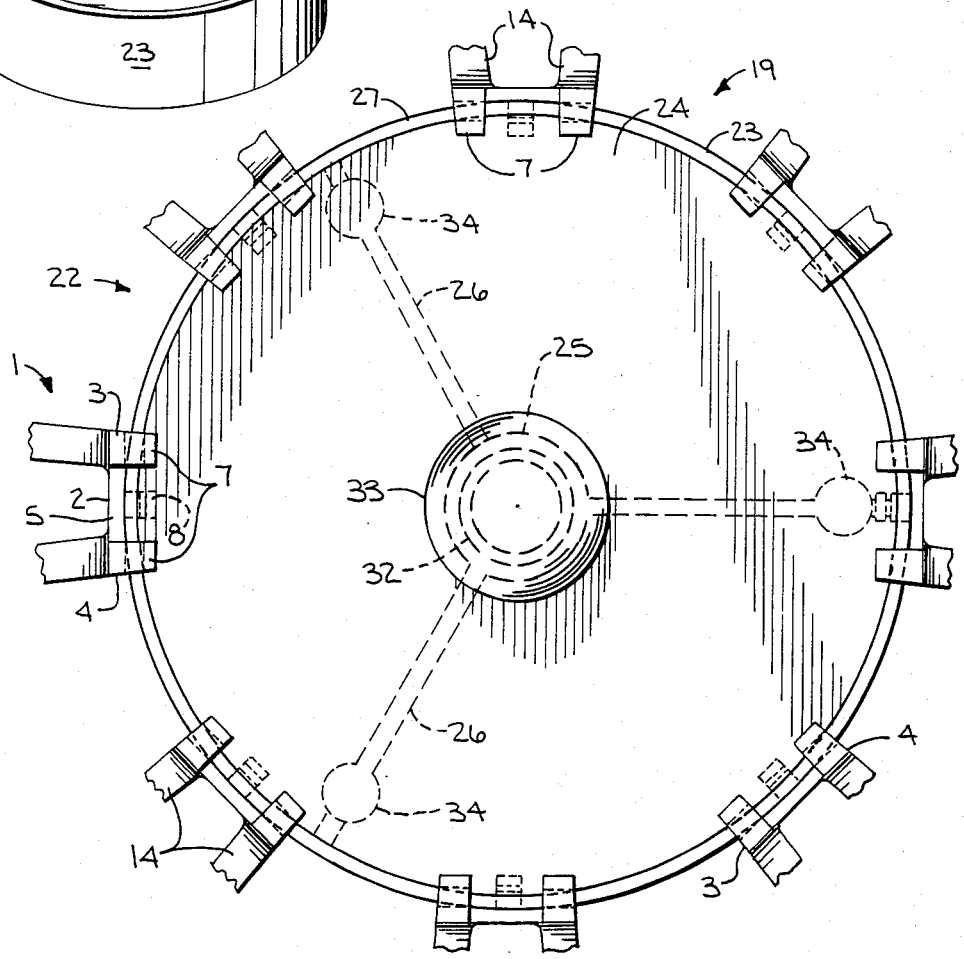
FIG. 4 is a top plan view of one of the clip supports, taken on line 4—4 of FIG. 1.
Figure 2:
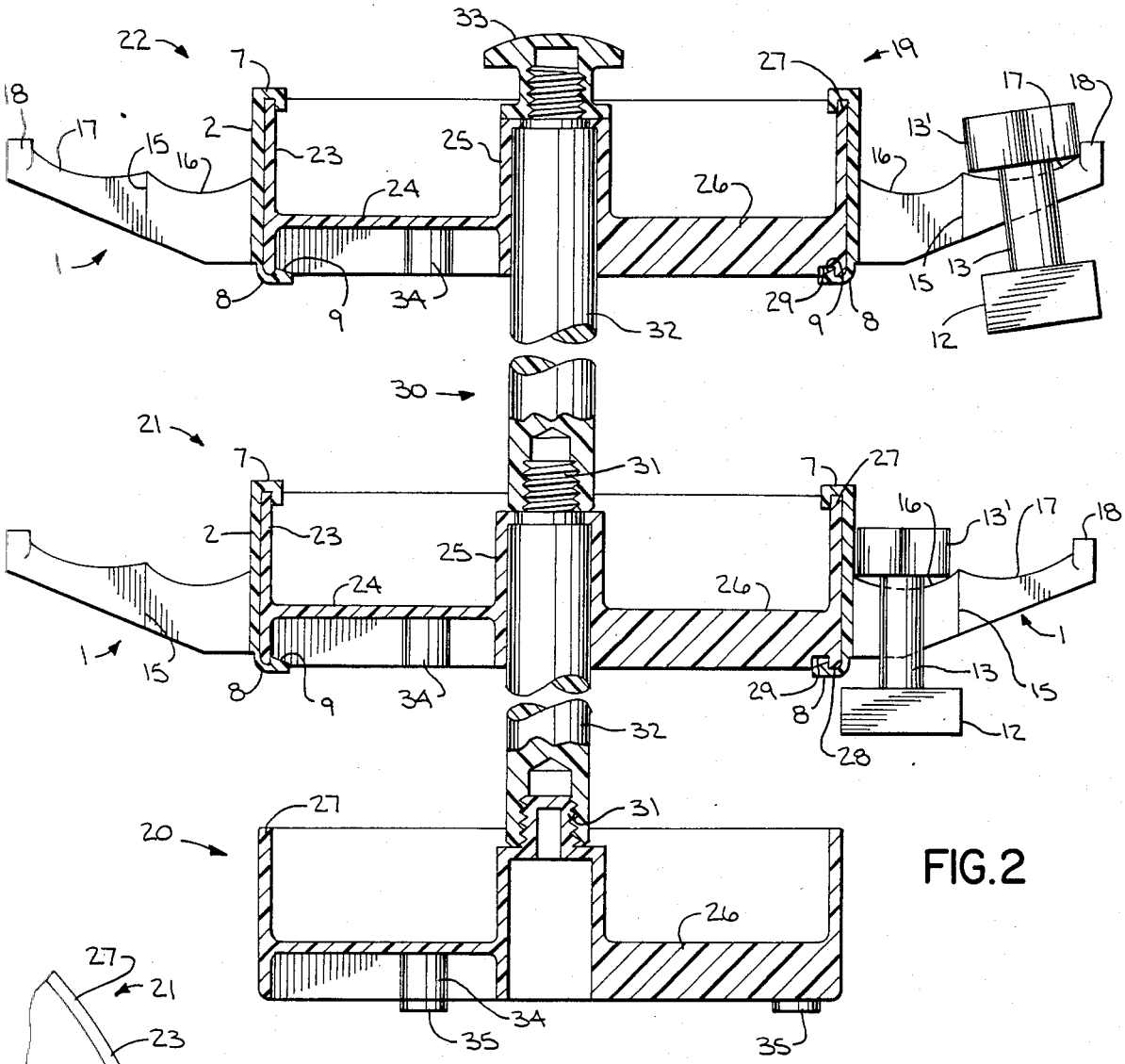
FIG. 2 is a central vertical section taken on line 2—2 of FIG. 1.

As shown in the drawings, the stamp holding unitary clip 1 of the invention comprises a generally planular base 2 having side edges 3 and 4 as well as upper and lower edge portions 5 and 6. Edge portions 5 and 6 are provided with means for attaching clip 1 to a supporting structure, to be described. For this purpose, upper edge portion 5 is provided with a pair of downwardly depending spaced hooks 7 for fitting over the support structure while lower edge portion 6 is provided with a single hook 8 having an upwardly extending barb 9 thereon and disposed, in plan, centrally between hooks 7. See FIG. 4.

Clip 1 is preferably made of molded plastic and is constructed to receive and support a rubber stamp or the like for easy storage and retrieval. Two types of stamps are shown. One stamp 10 has a generally circular tapered handle 11, while the other stamp 12 has a handle 13 with a wide knob 13' at its upper end.

Figure 3:
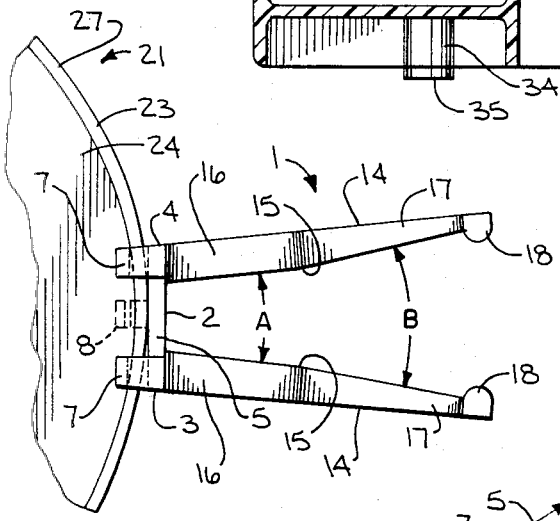
FIG. 3 is a fragmentary horizontal section taken on line 3—3 of FIG. 1.

Clip 1 is adapted to provide a universal mount for stamps of the type illustrated, and other types as well, without the need for spring biasing. For this purpose, a pair of relatively rigid arms 14 diverge outwardly from the front face of base 2 and form an open-ended channel therebetween. As can best be seen in FIG. 3, the angle of planular divergence of the opposed inner arm surfaces is relatively narrow adjacent base 2, as at A, but increases as at B from a location 15 generally centrally between the inner and outer arm ends.

The upper edges of arms 14 are provided with means for supporting a plurality of sizes of stamp knobs 13'. For this purpose, the upper arm edges are formed with a pair of arcuate support surfaces 16 and 17 therealong which intersect at location 15. Inner surface 16 is of shorter radius than outer surface 17. Furthermore, inner surface 16 is formed in the inner portions of arms 14 and coextensive with the relatively narrow angle of divergence, with outer surface 17 being formed in the outer portions of arms 14 and coextensive with the wider angle of divergence.

Opposed transversely inwardly facing knob-like projections 18 are disposed on the outer ends of arms 14.

When a stamp 10 is to be stored, the lower smaller portion of its tapered handle 11 is inserted freely inwardly between projections 18 and into the space between arms 14. The stamp is then lowered until its handle engages the diverging arm surfaces and then freely hangs thereon. Any tendency of handle 11 to slide outwardly on the surfaces will be stopped by the retaining projections 18.

When a stamp 12 is to be stored, its handle portion 13 is inserted inwardly between projections 18, and then lowered so that its knob 13' nests onto the pair of arcuate surfaces 16 or 17, depending on the size of stamp 12. The drawings illustrate two sizes of freely hanging stamps 12.

FIGS. 1–4 illustrate one embodiment of clip-supporting rack 19. As shown, rack 19 is preferably made of molded plastic and comprises an assembly of a plurality of spaced unitary dished clip supports 20, 21 and 22, each of which includes a circular peripheral side wall 23, a floor 24, a central hub 25, and radial strengthening ribs 26 extending beneath floor 24 between hub 25 and side wall 23. Side wall 23 is provided with an upper edge 27 as well as a lower pointed edge 28 spaced below floor 24.

For assembling one or more clips 1 to any of supports 20–22, upper clip hooks 7 are hung downwardly over support edge 27 and the lower clip edge portion 6 is pressed inwardly until lower hook 8 snaps onto lower support edge 28 so that barb 9 is caught behind the edges point. A clip 1 can easily be slid in either direction around side wall 23, with a small transverse groove 29 disposed in the outer end portions of ribs 26 permitting passing of the end of lower hook 8 therethrough.

Clip supports 20–22 are adapted to be mounted in a free standing tiered arrangement by a central post, indicated generally at 30. As shown, each support hub 25 is provided with a reduced threaded portion 31 on its upper end which threadably receives the lower portion of a post segment 32. The upper portion of each post segment is received within the hub 25 of the next higher unit so that the latter can freely rotate thereon about a vertical axis in the manner of a carousel or Lazy Susan. A cap 33 which may be used as a handle is screwed onto the uppermost threaded portion 31.

It should be noted that in the event clip supports 20–22 are rotated at a fast speed, stamps 10 will be prevented from flying off rack 19 by centrifugal force by virtue of retaining projections 18, and arcuate surfaces 16 and 17 will hold stamps 12 in position.

Because the weight of each suspended clip support 21, 22 together with any clips and stamps attached thereto is carried downwardly through the central post 30, the entire rack 19 is very stable and does not tend to tip. Thus, the bottom clip support 20 need be no larger in diameter than supports 21 and 22, so that all three clip supports can be identical. Only a single die is needed for molding the clip supports, with a resultant cost saving.

For supporting rack 19 on a counter or the like, downwardly extending enlarged bosses 34 are formed adjacent the outer ends of ribs 26 and felt or rubber pads 35 can be secured to the lower boss surfaces.

The dished shape of clip supports 20–22 creates receptacles for storage of small items such as paper clips, rubber bands, thumb tacks or the like.

Figure 5:
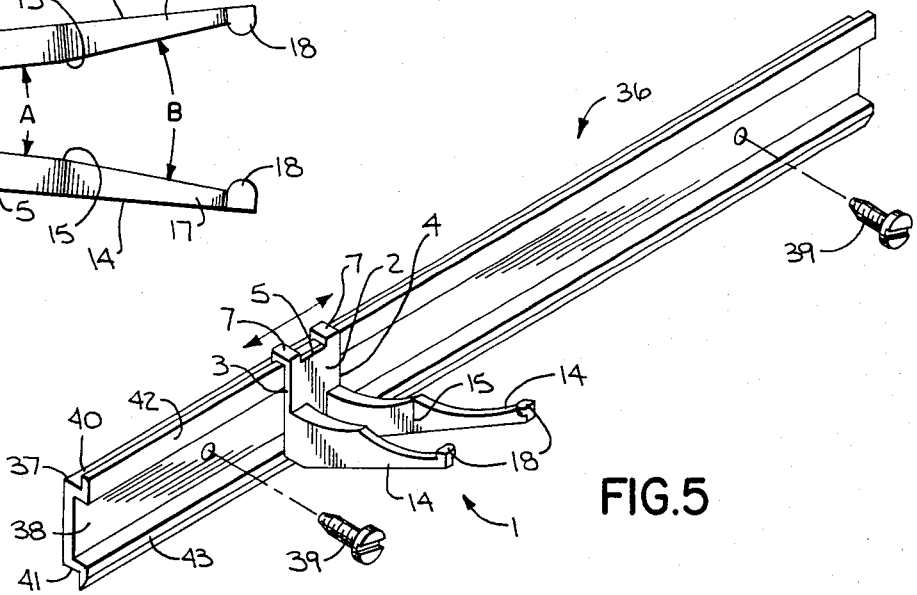
FIG. 5 is a perspective view of a stamp holding clip mounted to another form of supporting rack.

FIG. 5 illustrates another embodiment of clip-supporting rack 36. In this instance, the rack comprises a straight elongated channel member 37 having a wall or web 38 which may be secured to a wall, not shown, in any suitable manner such as screws 39. Web 38 joins a pair of outwardly extending legs 40 and 41 which terminate in respective transverse upper and lower flanges 42 and 43. Flanges 42 and 43 correspond generally with upper and lower edges 27 and 28 of rack 19, with flange 43 also being pointed to receive and catch barb 9 of a clip 1. The flanges are parallel to and spaced from web 38 to provide an offset clearance from the wall for hooks 7 and 8 when assembling a clip 1 to rack 36. The construction permits one or more clips 1 to be slideably positioned on rack 36.

The concepts of the invention provide a substantial improvement over previously known storage devices involving stamp holding clips and their associated racks. All of the parts are readily and inexpensively manufactured. Little or no maintenance is needed, and the various elements can easily be replaced, if necessary.

Various modes of carrying out the invention are contemplated as being within the scope of the following claims particularly pointing out and distinctly claiming the subject matter which is regarded as the invention.

We claim:

1. A storage device including a clip for mounting the handle of a rubber stamp or the like, said clip of said storage device comprising:

(a) a base, (b) a pair of relatively rigid arms extending from said base, (c) the opposed inner surfaces of said arms diverging outwardly from said base to the outer ends of said arms and being adapted to engagingly support handles of a variety of sizes, (d) and opposed inwardly facing handle retainer means disposed on the outer ends of said arms, (e) each of said arms having a plurality of arcuate top edge surfaces for free suspension of stamp handles therefrom.

2. The storage device of claim 1 wherein each of said plurality of arcuate top edge surfaces of each said clip arm is of different radii along the length of said arm.

3. The storage device of claim 1:

(a) which includes a pair of said arcuate top edge surfaces on each arm of said clip, (b) and wherein the radius of the arcuate surface disposed at the inner end portion of a said arm is less than the radius of the other arcuate surface disposed outwardly thereof.

4. The storage device of claim 1:

(a) which includes a pair of said arcuate top edge surfaces and a pair of said diverging surfaces on each said arm of said clip, (b) wherein the radius of the arcuate surface disposed at the inner end portion of a said arm is less than the radius of the other arcuate surface disposed outwardly thereof, (c) and wherein the angle of divergence of the diverging surfaces disposed at the inner end portions of a said pair of arms is less than the angle of divergence of the other diverging surfaces disposed outwardly thereof.

5. The storage device of claim 4 wherein the said arcuate surfaces of lesser radius of a said pair of arms of said clips are coextensive with the said diverging surfaces of lesser angle of divergence of said pair of arms.

6. The storage device of claim 4 which includes rack means for selectively mounting a plurality of said clips, said rack means comprising:

(a) a plurality of clip supports and with each said clip support comprising a circular peripheral clip-receiving side wall and a floor to form a small object storage receptacle, (b) and post means centrally mounting said plurality of clip supports in spaced tiered relationship for rotation of said clip supports about a vertical axis, (c) said post means forming means to carry the weight of said plurality of clip supports and clips mounted thereon to the bottom of said rack means.

7. The storage device of claim 6:

(a) in which each said clip support of said rack means is adapted to slidingly mount clips having hook means extending inwardly beneath the lower edge of said peripheral side wall, (b) in which said clip support includes radially extending ribs disposed beneath said floor, (c) and which includes grooves disposed in said ribs for permitting pass-through of said hook means when a said clip is slidingly moved along said side wall.

8. The storage device of claim 4 which includes rack means for selectively mounting a plurality of said clips, said rack means comprising:

(a) an elongated channel member having a web for mounting to a wall, (b) said web joining a pair of outwardly extending legs, (c) and transversely extending upper and lower flange means disposed parallel to and spaced from said web for mounting a said clip thereto.

9. A storage device including a clip for mounting the handle of a rubber stamp or the like, said clip of said storage device comprising:

(a) a base, (b) a pair of relatively rigid arms extending from said base, (c) the opposed inner surfaces of said arms diverging outwardly from said base to the outer ends of said arms and being adapted to engagingly support handles of a variety of sizes, (d) and opposed inwardly facing handle retainer means disposed on the outer ends of said arms, (e) each of the said opposed inner surfaces of said arms of said clip defining plural, angularly related planar surfaces, the inner surfaces of said arms thereby diverging at a plurality of different angles.

10. A storage device including a clip for mounting the handle of a rubber stamp or the like, said clip of said storage device comprising:

(a) a base, (b) a pair of relatively rigid arms extending from said base, (c) the opposed inner surfaces of said arms diverging outwardly from said base to the outer ends of said arms and being adapted to engagingly support handles of a variety of sizes, (d) and opposed inwardly facing handle retainer means disposed on the outer ends of said arms, (e) a pair of said diverging surfaces being disposed on each arm of said clip, (f) the angle of divergence of the diverging surfaces disposed at the inner end portions of a said pair of arms being less than the angle of divergence of the other diverging surfaces disposed outwardly thereof.

11. A storage device including a clip for mounting the handle of a rubber stamp or the like, said clip of said storage device comprising:

(a) a base, (b) a pair of relatively rigid arms extending from said base, (c) the opposed inner surfaces of said arms diverging outwardly from said base to the outer ends of said arms and being adapted to engagingly support handles of a variety of sizes, (d) and opposed inwardly facing handle retainer means disposed on the outer ends of said arms, (e) said base of said clip having a pair of upper and lower edge portions, (f) and means associated with said edge portions for mounting said clip to a clip support having a wall with an upper edge and a lower edge with at least one of said last-named edges being pointed, said mounting means comprising:

(1) upper and lower hook means disposed on said upper and lower edge portions of said base for engagement with a respective upper and lower edge of a said support wall, (2) at least one of said upper and lower hook means having barb means thereon for snap-in catching on a said pointed edge.

* * * * *